US012680324B2

(12) United States Patent
Pirok

(10) Patent No.: US 12,680,324 B2
(45) Date of Patent: Jul. 14, 2026

(54) LASZLO STUD LEVELER

(71) Applicant: Laszlo Pirok, San Antonio, TX (US)

(72) Inventor: Laszlo Pirok, San Antonio, TX (US)

( * ) Notice: Subject to any disclaimer, the term of this patent is extended or adjusted under 35 U.S.C. 154(b) by 81 days.

(21) Appl. No.: 18/233,722

(22) Filed: Aug. 14, 2023

(65) Prior Publication Data

US 2024/0301705 A1 Sep. 12, 2024

Related U.S. Application Data

(60) Provisional application No. 63/475,313, filed on Oct. 31, 2022.

(51) Int. Cl.
*E04G 21/18* (2006.01)

(52) U.S. Cl.
CPC ..... *E04G 21/1841* (2013.01)

(58) Field of Classification Search
CPC ..... E04G 21/1841; E04G 21/1825
See application file for complete search history.

(56) References Cited

U.S. PATENT DOCUMENTS 5,163,233 A * 11/1992 Benson ..... E04G 21/1841 269/904
6,434,848 B1 * 8/2002 Gordon ..... E04F 21/04 33/528
6,502,322 B2 * 1/2003 Smochek ..... G01C 9/26 33/373
7,059,059 B1 * 6/2006 Ames ..... G01C 9/28 33/372
7,254,920 B2 * 8/2007 Steele ..... E04F 21/185 33/371
8,191,335 B2 * 6/2012 Davis ..... E04G 21/1891 33/645
11,505,952 B1 * 11/2022 Lewis ..... E04F 21/18
11,821,578 B2 * 11/2023 Bélanger ..... B25H 7/00
2006/0265895 A1 * 11/2006 Daugherty ..... G01B 3/04 33/613
2011/0219724 A1 * 9/2011 Davis ..... E04G 21/1891 33/354
2013/0318804 A1 * 12/2013 Harris ..... G01C 9/26 33/343
2022/0214011 A1 * 7/2022 Bélanger ..... E06B 1/02
2024/0084611 A1 * 3/2024 Lewis ..... E04G 21/1841
2024/0301705 A1 * 9/2024 Pirok ..... E04G 21/1825

* cited by examiner

*Primary Examiner* — Yaritza Guadalupe-Mccall

(57) ABSTRACT

The present invention describes a highly effective wall and stud control system that ensures perfect plumb and even surfaces for various types of wall boards, tile backer boards, and tile foam boards. The system consists of three key components: Part A, a full piece with a breakaway connection and holes; Part B, a full piece with a breakaway connection and slots; and Part C, a corner piece. Each part serves a specific purpose in the system. Part A is attached to the top and bottom of the studs, providing maximum strength through the holes. Part B is used to level out the studs by attaching it between Part A. Part C is utilized in corners where Part A and Part B cannot be installed and also around the shampoo box in the shower area. All these components can be installed over nail plates. The stud leveler finds applications in both shower areas and throughout the entire framed house to ensure level and straight walls before wallboard installation. It is designed for use by builders, contractors, and DIYers. Stud leveler system is providing a reliable solution for both residential and commercial applications.

5 Claims, 6 Drawing Sheets

LASZLO STUD LEVELER

TECHNICAL FIELD

The present invention relates to the construction field, specifically to wall and framing surfaces. It also pertains to tiles and the placement and installation of tiles on wall surfaces. The invention provides a device, system, and method for accurately controlling and maintaining straight and plumb surfaces during the installation of various wall boards, tile backer boards, and wall tiles.

BACKGROUND OF THE INVENTION

Uneven walls and studs in showers often lead to spot bonding issues on tile surfaces, resulting in mold problems behind the tiles and compromising the aesthetic appearance of the installation. Consequently, achieving plumb and straight walls during wallboard installation is a primary objective. In the construction field, uneven and out-of-plumb walls/studs pose significant challenges for the tile industry. To ensure a flat ceramic or stone installation, carpenters and other trades must meet the tile industry's flatness tolerance standards. If substandard surfaces are encountered, they must be corrected before installation to maintain the quality and integrity of the tile installation. Failure to address these issues can lead to water intrusion, hollow-sounding tiles, and other problems that jeopardize the durability and aesthetics of the installation. Various methods have been used to address these challenges, such as wet shimming, foam shimming, and drywall shims. However, these methods have drawbacks, including the need for curing time, limitations on specific types of tile backer boards, time-consuming installation, and limited accuracy. The stud leveler system can still find utility in a range of applications beyond commercial and residential settings. Here are some areas where the system could be used: Construction Sites: The stud leveler system can be employed in construction projects, including infrastructure development and building renovations. It provides a convenient method for ensuring the straightness and alignment of temporary structures and formwork. The system's adjustability allows for easy leveling and alignment during the construction process. Exhibition and Event Setup: The stud leveler system can be utilized in exhibition booths, trade shows, and event setups where temporary walls or partitions are required. It offers a quick and efficient way to create straight and level walls for displaying products, branding, or dividing event spaces. The system's versatility allows for easy adjustments and reconfiguration as per the event requirements. Stage and Set Design: In the entertainment industry, such as theaters, concert halls, and film sets, the stud leveler system can be used for stage and set construction. It ensures the accuracy and stability of set pieces, platforms, and backdrops. The system's adjustability allows for precise leveling and alignment, providing a solid foundation for performers and props.

Art Installations: Artists and sculptors can benefit from the stud leveler system when creating large-scale installations or outdoor artworks. It assists in achieving the desired alignment, straightness, and stability of artistic structures, sculptures, and installations. The system's flexibility allows for adjustments and fine-tuning during the installation process.

Exhibition Displays and Booths: Besides trade shows, the stud leveler system can be utilized in various exhibition settings, such as museums, galleries, and product showcases. It provides a reliable method for creating level walls and displays for exhibiting artwork, artifacts, or products. The system's adjustability allows for customization and adaptability to different exhibition layouts. DIY and Home Improvement: The stud leveler system can be used by DIY enthusiasts and individuals undertaking home improvement projects. It provides a user-friendly solution for ensuring straight and plumb walls when installing shelves, cabinets, and other fixtures. The system's adjustability allows for easy leveling and alignment without the need for specialized tools. These are just a few examples of how the stud leveler system can be applied in various contexts beyond commercial and residential settings. Its ability to provide accurate leveling and alignment makes it a valuable tool in different industries and applications where precise positioning is required.

Description

In the construction field, the tile industry faces significant challenges due to uneven and out-of-plumb walls and studs. To achieve a satisfactory ceramic or stone tile installation, carpenters and other trades must adhere to the tile industry's flatness tolerance standards. If substandard surfaces are encountered, they must be corrected before commencing the installation to ensure the substrate is ready for tiling. Failure to complete the appropriate preparation work may result in an unacceptable final appearance and may not meet ANSI A 108 requirements, especially in wet areas like showers where 95% mortar coverage is required. Insufficient mortar coverage can lead to water infiltration in areas with gaps or voids in the mortar. To compensate for uneven surfaces, tile contractors often resort to spot bonding, also known as five-spotting, during tile installation. However, this practice is not recommended as it can lead to tile failure over time, hollow-sounding tiles, and improper support for shower doors in the long run. Installing tile in shower corners can further diminish the aesthetic appearance of the installed tile due to out-of-plumb studs. As a result, tile installers often resort to spot bonding, which has become a common problem leading to failures in ceramic tile installations. The issue of spot bonding was highlighted at Coverings 2018 in the Installation Experience Hall of Failures, and it continues to raise concerns among ceramic tile professionals and certification offices. To address these challenges, various methods have been employed, such as wet shimming, foam shimming, and drywall shims. However, each method has its drawbacks. Wet shimming using certain A118.1/.4/.11/.15 thin-set mortars allows minor rendering off the walls in wet areas, but requires proper curing before wallboard installation, limits the use to foam tile backer boards, and imposes maximum bond coat thickness restrictions. Foam shims, attached to the front of studs with liquid nails, offer an alternative solution. However, multiple layers of different thickness foam shims are often necessary on out-of-plumb studs, which can be cumbersome. Drywall shims, stapled to the face of studs in layers, can also be employed. Nevertheless, this method is time-consuming, often requires multiple layers on out-of-plumb studs, and may not guarantee 100% accuracy. To overcome these challenges and provide a comprehensive solution, a stud leveling system is introduced. This device accurately and consistently controls plumb and straight surfaces on the studs while simultaneously ensuring precise control over the walls. The stud leveling system is easy and fast to install, saving time and improving the efficiency of all types of wallboard and tile installations. With this invention, tile installers no longer need to resort to spot bonding to achieve plumb walls, and it effectively eliminates mold issues behind tiled walls in wet areas. Furthermore, the system greatly enhances the aesthetic appearance of tile installations.

BRIEF DESCRIPTION OF THE DRAWINGS

The accompanying drawings, which are incorporated herein and form a part of the specification, illustrate embodiments of the stud leveler and, together with the detailed description, serve to explain the principles and operation of the invention.

DETAILED DESCRIPTION

Figure 1:
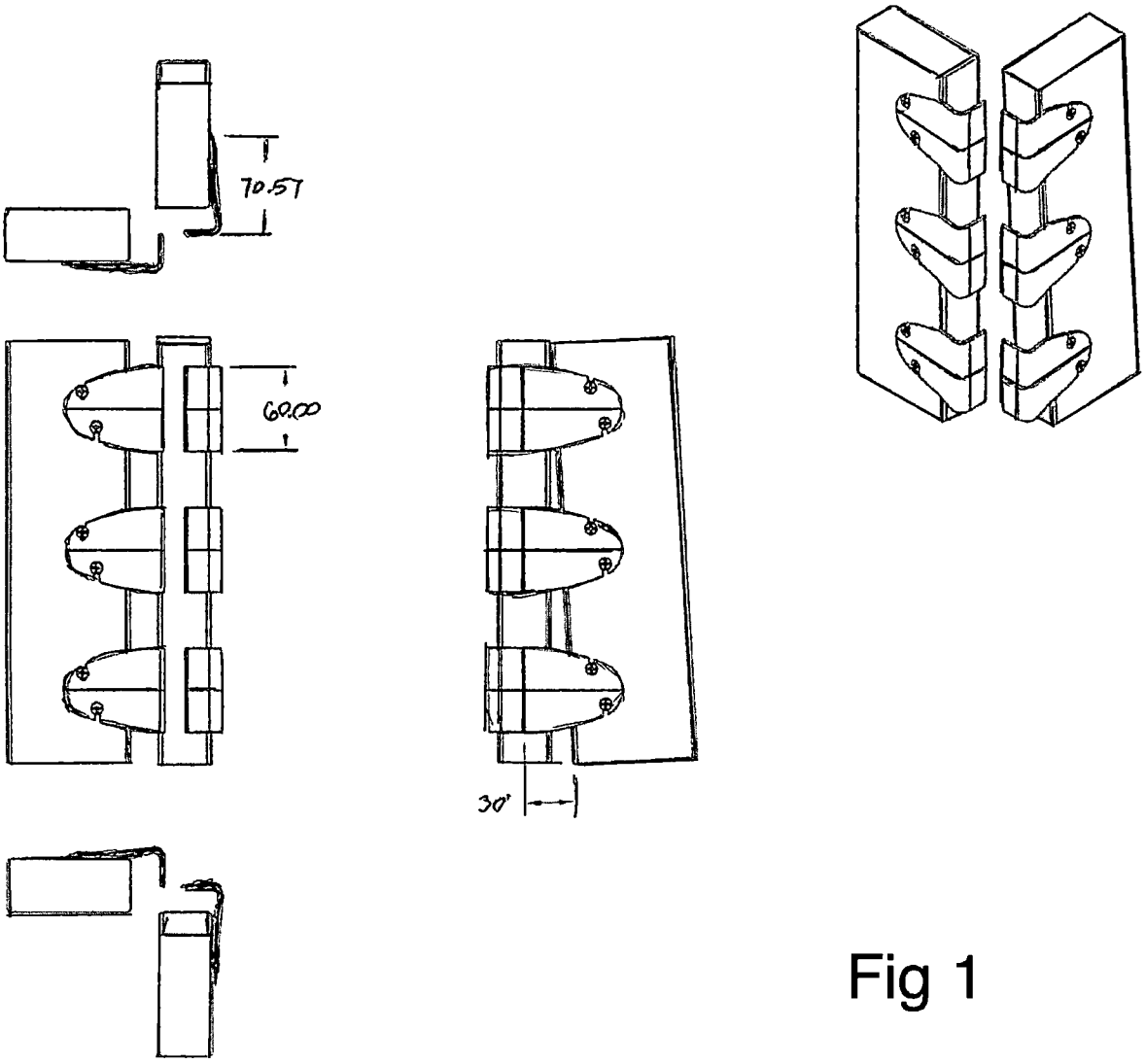
FIG. 1 illustrates corner pieces separated by force from a full stud leveler piece, wherein the separated corner pieces are configured for installation and alignment within wall corners.

The stud leveler has several key features that make it unique and advantageous. Here are some of its key features:

The stud levelers end is expertly beveled, ensuring seamless and effortless placement onto the stud allowing for smooth and hassle free operation of the stud leveler.

Breakaway Connection: The stud leveler incorporates a breakaway connection mechanism. This feature allows the full pieces to separate, creating a corner piece. The breakaway connection is designed to provide a predetermined and intentional fracture location, ensuring controlled separation and easy installation.

Adjustable and Versatile: The stud leveler is designed to be adjustable, allowing for precise leveling and alignment of walls and studs. It can be adjusted up or down, in or out of the stud to achieve perfect plumb. This feature ensures flexibility and adaptability to different construction scenarios and materials. Material Composition: The stud leveler is made of durable materials such as ABS or other suitable plastics such as but not limited to homopolymers, Acetal, polyoxymethylene, ABS-PC, Nylon, glass-filled nylon, Vinyl, HDPE, and Polypropylene. Additionally, it can be constructed using metal, aluminum, or plastics with glass fibers. The choice of materials ensures strength, longevity, and compatibility with various construction materials.

Self-Gripping Feature: The stud leveler incorporates a self-gripping mechanism. This means that it does not require manual holding or support during installation. Once positioned on the stud, it slides up and down, in and out, and holds itself in place until it is securely fastened. This feature enhances ease of use and accuracy during the leveling process.

Universal Application: The stud leveler is designed for use with different types of wall boards and tile backer boards. It can be applied to various materials such as plywood, wooden paneling, solid and engineered wood sheets, wainscoting, veneer and laminate paneling, MDF paneling, metal paneling, chipboard paneling, PVC paneling, and sheetrock wallboards. This wide range of compatibility makes the stud leveler suitable for diverse construction projects. These key features collectively contribute to the effectiveness, versatility, and user-friendliness of the stud leveler. By incorporating these features into the stud leveler, it provides a comprehensive solution for controlling and leveling straight walls and studs in various construction applications. The stud leveler is a key component of the wall and stud leveling system. It is designed to provide control and leveling of straight walls and studs for various types of wall boards and tile backer boards. Here is some additional information about its structure, components, and operation.

Structure: The stud leveler is typically a separate element that can be attached to a framing stud in a wall or other similar structures. It is designed to be adjustable, allowing for precise positioning and alignment of the stud.

Components: The specific components of the stud leveler may vary depending on the design and implementation. However, some common components may include:

Fracture Zone: The stud leveler may have a predetermined fracture zone or breakaway connection. This fracture zone is designed to create a corner piece when sufficient force is applied, allowing for the creation of corners in walls.

Operation: The stud leveler is used to achieve precise alignment and leveling of studs in walls. Here's a general overview of its operation: Attachment: The stud leveler is attached to the framing stud at the desired location. It may be secured using screws, nails, or other fastening means.

Adjustment: The adjustable mechanism of the stud leveler allows for fine-tuning of the stud's position. By adjusting the mechanism, the stud can be moved up or down, in or out to achieve the desired alignment and levelness.

Corner Creation: In cases where corners need to be formed, the stud leveler's breakaway connection comes into play. When sufficient force is applied, the stud leveler separates at the predetermined fracture zone, creating a corner piece that facilitates the construction of corners in walls. The stud leveler provides a reliable and efficient means of controlling and leveling studs, ensuring the straightness and alignment of walls. Its adjustable nature allows for flexibility and accuracy during installation. The stud leveler incorporates a breakaway connection that is designed for easy separation when required, while maintaining exceptional strength to securely hold various types of wall boards when fastened. Additionally, the stud leveler possesses another notable feature: when it is perfectly aligned and plumbed, and there is an excessive gap between the stud leveler and the stud where the fastener does not reach, the stud leveler has the capability to support and hold the wall boards in place, even in the absence of direct fastening to the stud. This breakaway connection offers the advantage of effortless separation when needed, ensuring convenience during installation or when adjustments are required. However, when the stud leveler is securely fastened, it exhibits remarkable strength, providing reliable support for wall boards of different materials. Furthermore, the stud leveler's unique design allows it to compensate for situations where the gap between the stud leveler and the stud exceeds the reach of the fastener. In such cases, the stud leveler remains capable of effectively supporting the wall boards, maintaining their stability and preventing any sagging or instability, thereby ensuring a solid and secure wall assembly. These features of the stud leveler contribute to its versatility and usability, enabling the construction of straight and well-supported walls, even under challenging installation conditions. The stud leveler incorporates a flame retardant feature that enhances its safety and reliability. The stud leveler is manufactured using a carefully selected fireproof filament, specifically chosen for its enhanced fire resistance properties. This fireproof filament has been chosen to meet or exceed industry standards for flame retardancy, providing an additional layer of safety to the stud leveler. The material used in the stud leveler is designed to minimize the risk of ignition and limit the spread of flames, ensuring a safer environment in case of fire-related incidents. This helps to minimize the risk of fire propagation and provides an added layer of protection in residential, commercial, and other building applications. By incorporating a flame retardant filament, the stud leveler offers increased safety and peace of mind. This feature ensures that the stud leveler complies with stringent fire safety regulations and standards, making it suitable for use in environments where fire safety is a critical consideration. Overall, the flame retardant feature of the stud leveler adds an important layer of protection, reducing the potential fire hazard and contributing to a safer construction environment. The self-gripping feature of the stud leveler is a notable innovation that enhances its ease of use and effectiveness in wall and stud leveling applications. This feature allows the stud leveler to securely grip the framing stud without the need for additional support or manual holding. This innovative feature eliminates the risk of hand injuries while fastening the stud leveler in place. When the stud leveler is positioned on the framing stud, it automatically engages with the surface and creates a firm grip. This means that once the stud leveler is released, it remains securely in place without requiring constant manual support or holding. This self-gripping capability simplifies the installation process and improves efficiency, as it eliminates the need for extra hands or tools to hold the stud leveler in position. The self-gripping feature ensures that the stud leveler maintains its position and alignment while adjustments are made. Whether the stud leveler is being adjusted vertically, horizontally, or in and out of the stud, it remains securely in place until it is fastened to the stud using appropriate fasteners. By incorporating the self-gripping feature, the stud leveler offers enhanced accuracy and convenience during the leveling process. It streamlines the installation workflow, reduces the risk of misalignment or slippage, and allows for precise adjustments to achieve a perfectly straight and plumb wall. Overall, the self-gripping feature of the stud leveler provides a practical and user-friendly solution, making it easier for professionals and DIY enthusiasts to achieve high-quality wall and stud leveling results. The corner and full peace design of the stud leveler is engineered to withstand significant force. When attaching wall boards to the stud leveler with substantial pressure, it effectively maintains the flatness of the substrate without any bending or breakage. The stud leveler features an optimal texture that strikes a balance between being too rough and too smooth. This carefully designed texture ensures a secure and safe installation process, preventing the stud leveler from slipping out of hands during use. The stud leveler is thoughtfully engineered to accommodate studs that deviate significantly from being plumb. This design feature allows for greater flexibility during installation, ensuring that the stud leveler can effectively compensate for significant variations in stud alignment. The slots in the stud leveler are intelligently designed to securely hold the fastener without the need for manual gripping. By eliminating the need to hold the fastener, the stud leveler promotes a safer and more efficient installation process, allowing to work with ease and confidence. Parts A and B are meticulously designed, paying close attention to every detail. When the fasteners are inserted through the slots or holes on both sides of the stud leveler, they will not come into contact with each other while the screw or nail is being attached. The stud leveler is skillfully designed with optimal length and width, eliminating the need for precise measurements. Its generous dimensions provide ample room for the fastener to securely penetrate the stud leveler, even in cases where the measurements are only approximately accurate. This eliminates the guesswork and allows for a hassle-free installation process, ensuring that the fastener finds a secure hold within the stud leveler, regardless of minor measurement deviations. The stud leveler offers the flexibility to be fastened to the studs outside of the slots or holes, ensuring a secure installation without the risk of cracks or breakage.

SUMMARY OF THE INVENTION

The present invention provides a comprehensive leveling system and method for achieving straight walls and studs in various applications, including wall boards and tile backer boards. One aspect of the present invention relates to a wall and stud control and leveling system comprising multiple components, including a full piece with slots and a breakaway connection, a corner piece, and a full piece with holes and a breakaway connection. These components can be separated by force to create the corner piece and can be installed over a nail plate for added stability.

The full piece with holes features a breakaway connection that offers a predetermined and intentional fracture location where the stud leveler separates, allowing for easy adjustments and installation. Having both Part A and Part B in the leveling system is important because they serve different purposes and work together to ensure effective control and leveling of walls and studs. Part A, which consists of a full piece with slots and a breakaway connection, and a corner piece, allows for the creation of corner sections. By applying force to separate the full piece with slots, it can be transformed into a corner piece, which is crucial for achieving precise corners and maintaining the alignment of the wall or stud. This feature ensures that the system can accommodate corners and angles accurately. On the other hand, Part B involves a full piece with holes and a breakaway connection. This component allows for adjustments, strength and fine-tuning of the stud leveler's position. By utilizing the breakaway connection and the predetermined fracture location, the full piece with holes enables easy separation and repositioning of the stud leveler. This adjustability ensures that the system can be customized to achieve the desired plumb and straight alignment of the walls or studs. By combining Part A and Part B, the leveling system provides a comprehensive solution for controlling and leveling walls and studs. Part A enables accurate corner formations, while Part B allows for precise adjustments and alignments. Together, they offer versatility and flexibility in achieving straight walls and studs in various applications. Another aspect of the present invention pertains to the materials used in the stud leveling control system. The stud leveler can be formed from various plastic materials, such as ABS, homopolymers, Acetal, polyoxymethylene, ABS-PC, Nylon, glass-filled nylon, Vinyl, HDPE, Poly Propylene, as well as metal materials like aluminum and plastics incorporating glass fibers. Furthermore, the wall and stud leveling control system of the present invention is suitable for various types of studs and metal framing. The stud leveler can be attached to a framing stud and adjusted vertically or horizontally to achieve precise alignment and ensure a perfectly plumb result. The present invention is applicable to a wide range of wall boards, including plywood, wooden paneling, solid and engineered wood sheets, wainscoting, veneer and laminate paneling, MDF paneling, metal paneling, chipboard paneling, PVC paneling, and sheet-rock wallboards. It enables the creation of straight and plumb walls in all these applications Additionally, the wall and stud leveling control system incorporates a self-gripping feature. The stud leveler is designed to slide smoothly along the stud and securely hold its position without the need for manual assistance, ensuring accuracy and ease of use during installation. Another advantageous feature of the present invention is the use of a carefully selected fireproof filament, specifically chosen for its enhanced fire resistance properties. This fireproof filament has been chosen to meet or exceed industry standards for flame retardancy, providing an additional layer of safety to the stud leveler. The material used in the stud leveler is designed to minimize the risk of ignition and limit the spread of flames, ensuring a safer environment in case of fire-related incidents. These aspects of the present invention collectively contribute to an improved system for achieving straight and plumb walls and studs in a variety of applications, offering ease of installation, accuracy, and fire-resistant characteristics. The stud leveler addresses a significant need in the construction industry and various DIY projects. Here are a few reasons why the stud leveler is a product in demand. Improved Efficiency: Traditional methods of leveling walls and studs often involve time-consuming and labor-intensive processes. The stud leveler streamlines the leveling process, allowing for quicker and more efficient installation of wall boards and tile backer boards. Its innovative design and features minimize the need for manual adjustments, resulting in time savings and increased productivity.

Enhanced Accuracy: Achieving precise alignment and plumbness is crucial in construction and carpentry work. The stud leveler offers a reliable solution for ensuring straight and level walls, studs, and other structural elements. With its adjustable and self-gripping capabilities, it allows for fine-tuning and adjustments to achieve optimal alignment, reducing the risk of uneven surfaces or misalignments.

Versatility: The stud leveler is designed to work with various types of wall boards, including plywood, wooden paneling, sheet-rock wallboards, metal paneling, and more. This versatility makes it suitable for a wide range of construction projects, from residential homes to commercial buildings, remodeling projects, and even DIY applications. Its compatibility with different materials adds to its value and appeal in the market.

Ease of Use: The stud leveler is designed to be user-friendly, catering to both professionals and DIY enthusiasts. Its intuitive design and self-gripping feature simplify the installation process, eliminating the need for complex tools or additional assistance. This ease of use makes the stud leveler accessible to a broader range of users, including those with limited construction experience.

Safety and Durability: The stud leveler is made from high-quality materials, including ABS plastic, metals, and flame-retardant filaments. These materials ensure durability, longevity, and resistance to wear and tear. Additionally, the flame-retardant feature enhances safety by reducing the risk of fire hazards, adding an extra layer of protection in construction environments. In summary, the stud leveler addresses the need for a more efficient, accurate, versatile, and user-friendly solution for wall and stud leveling. Its innovative features and practical benefits make it a sought-after product in the construction industry, helping professionals and DIY enthusiasts achieve excellent results while saving time and effort.

[Independent Claim]

Figure 2:
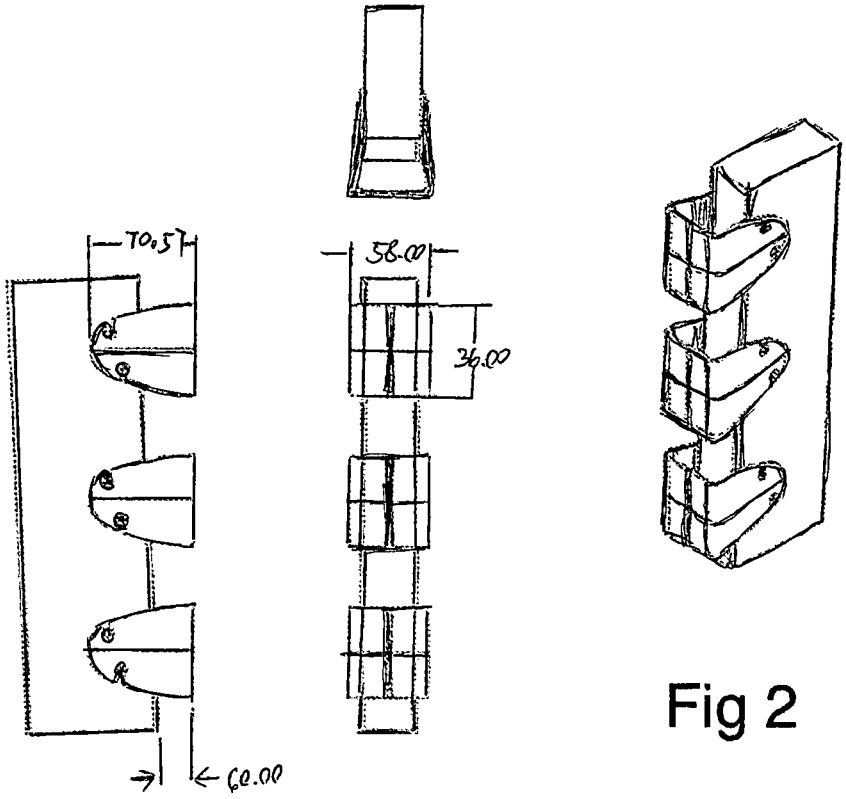
FIG. 2 illustrates various views of the stud leveler attached to a framing stud, including perspective, front, and side views, showing the arrangement and positioning of multiple stud levelers on the stud for wall leveling and alignment applications.
Figure 3:
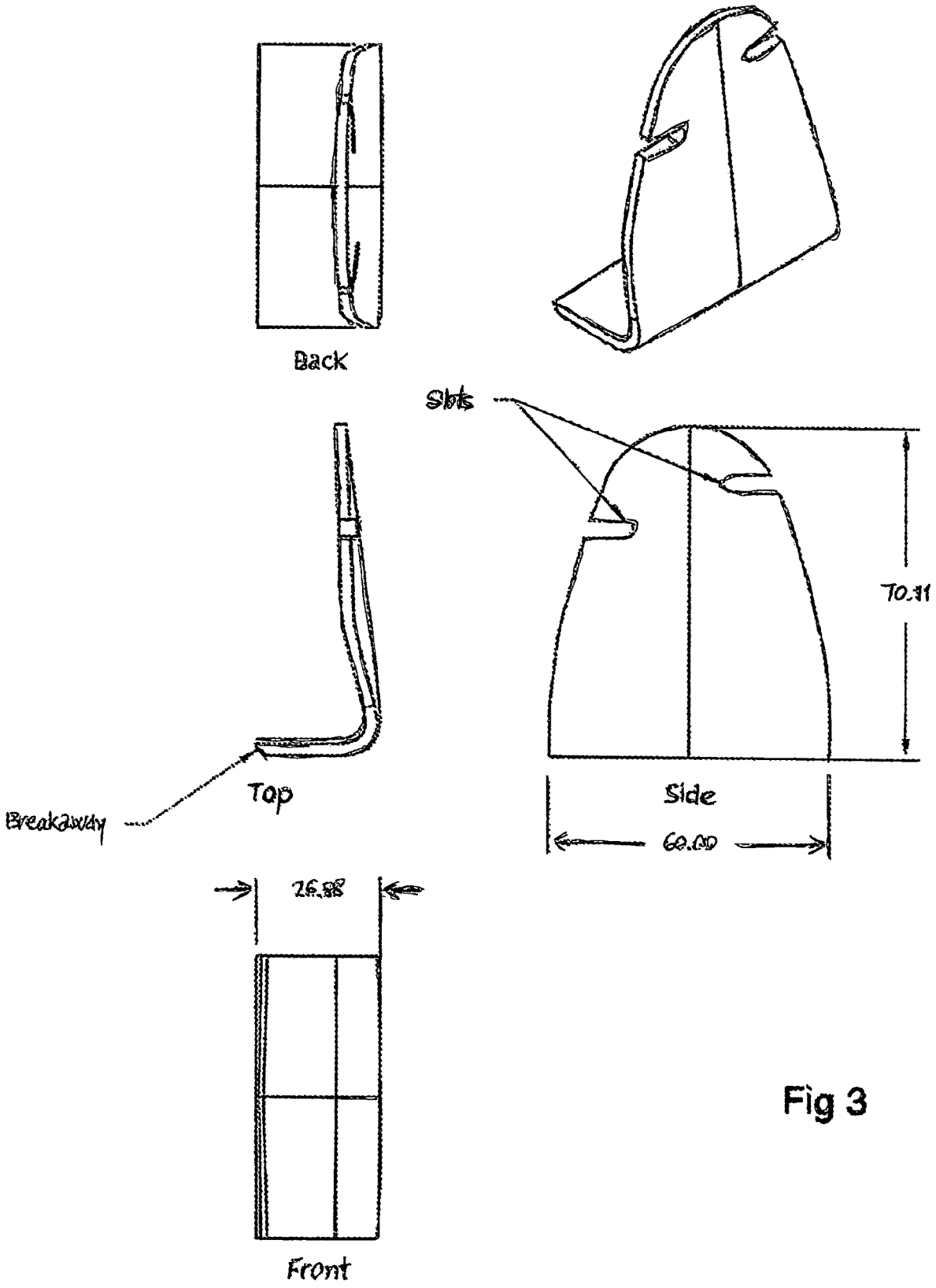
FIG. 3 illustrates various views of an individual stud leveler component, including front, side, top, back, and perspective views, showing the beveled end, breakaway connection, slot configuration, and overall structural design of the stud leveler.
Figure 4:
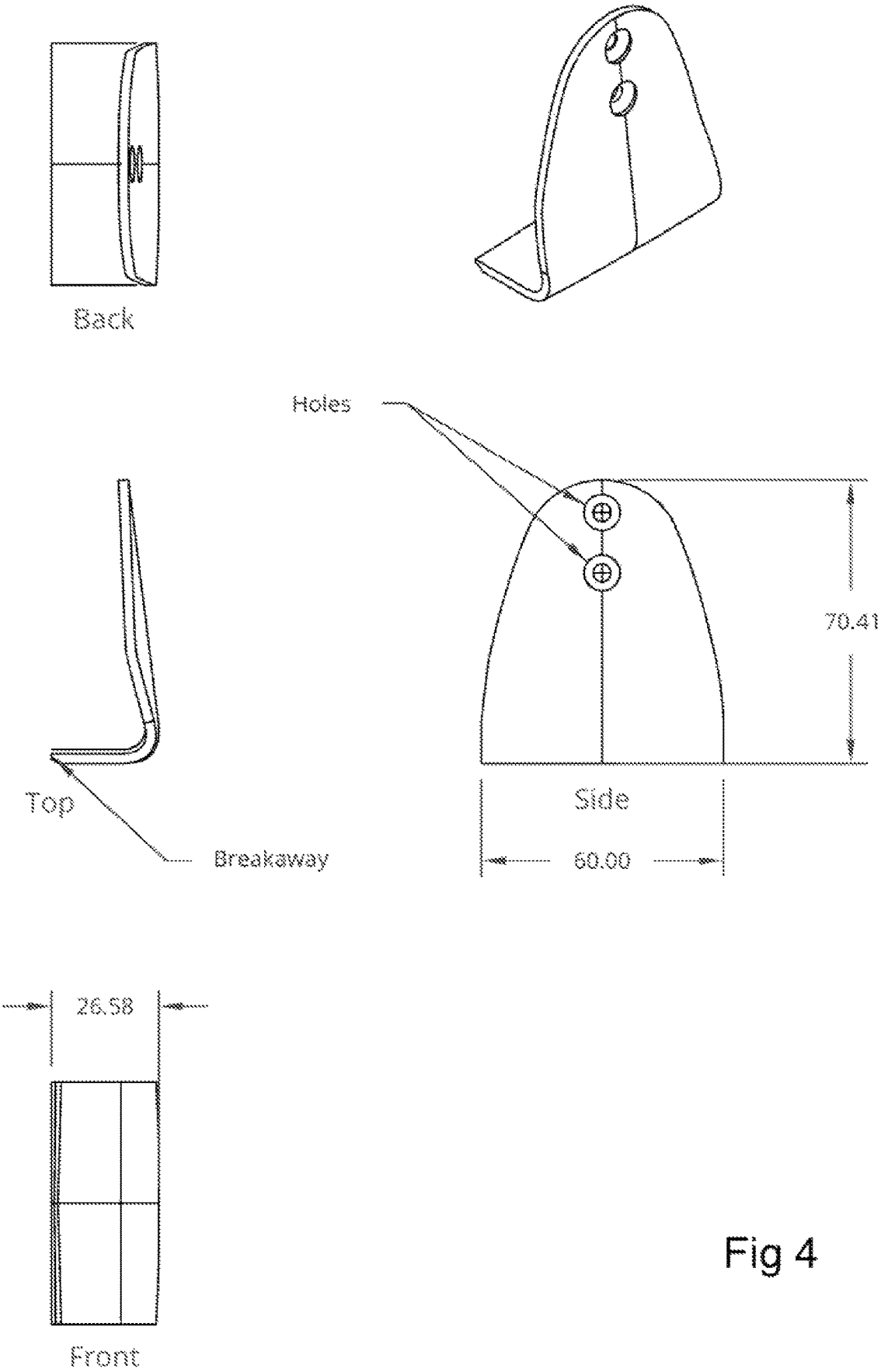
FIG. 4 illustrates various views of an individual stud leveler component, including front, side, top, back, and perspective views, showing an embodiment having fastener holes positioned on the sides of the stud leveler and the overall structural design of the stud leveler.
Figure 5:
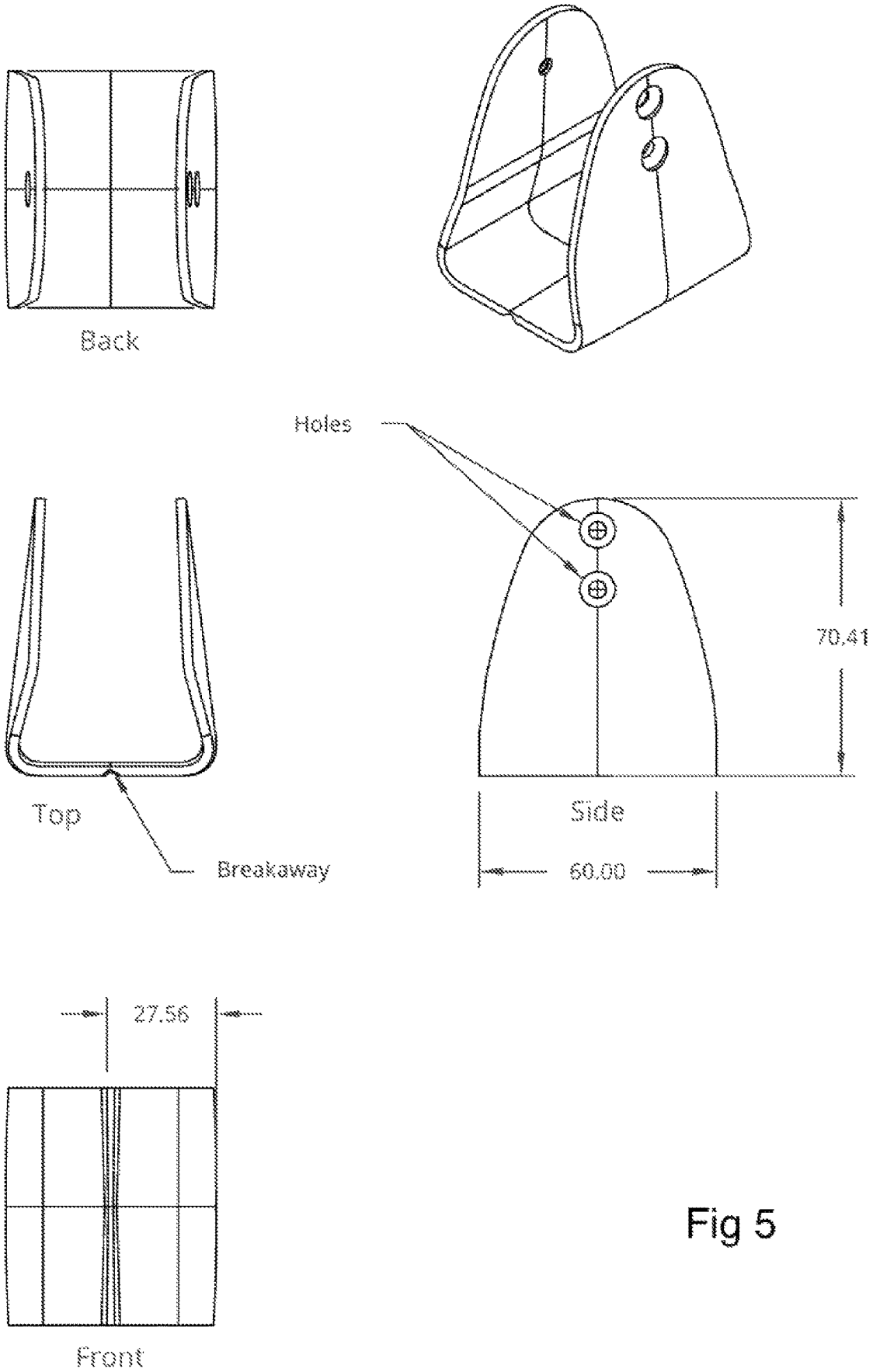
FIG. 5 illustrates a full stud leveler piece having fastener holes positioned on the sides of the stud leveler.
Figure 6:
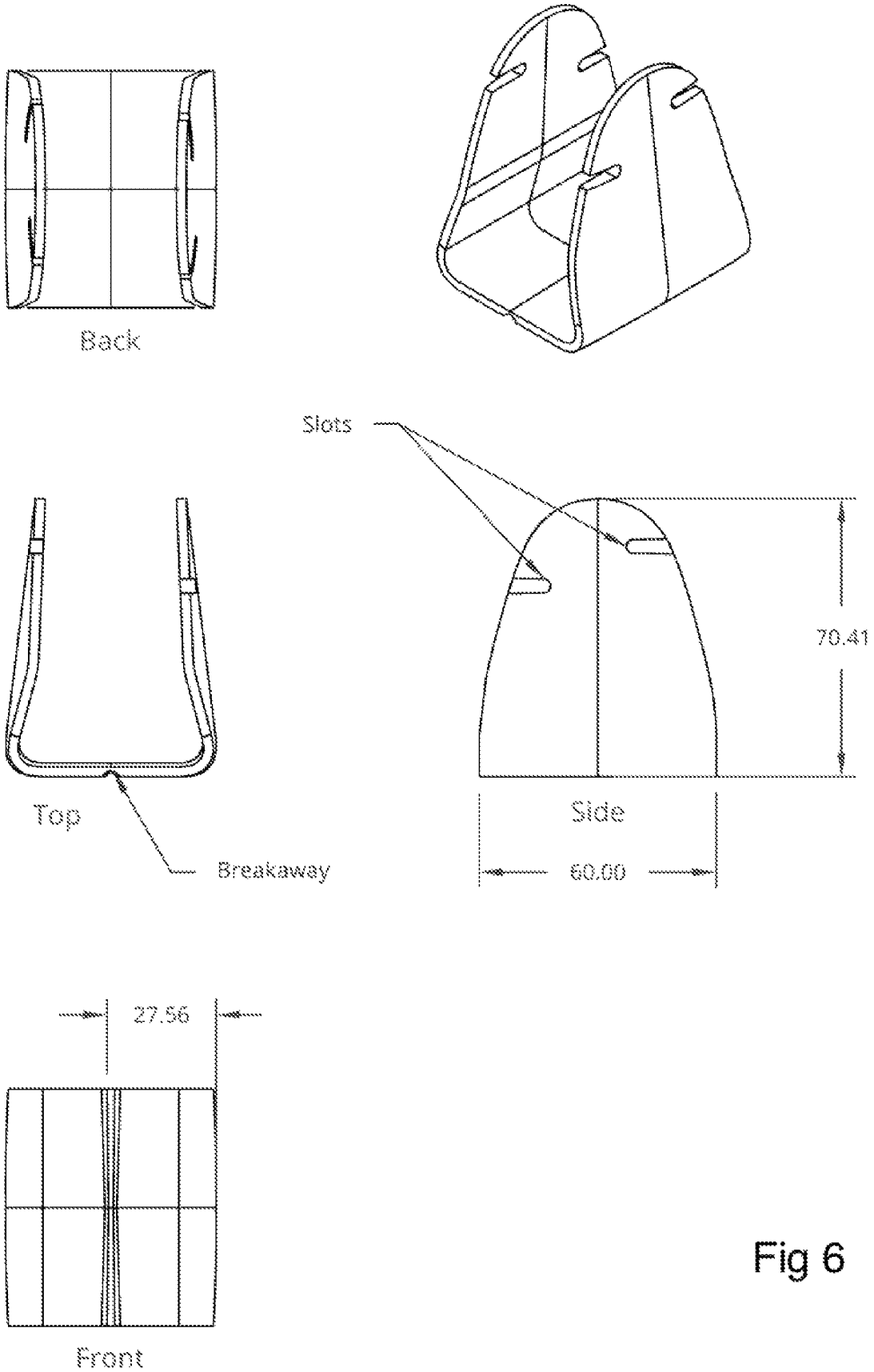
FIG. 6 illustrates a full stud leveler piece having fastener slots positioned on the sides of the stud leveler.

A stud leveling system for controlling and maintaining straight and plumb surfaces during the installation of wall boards, tile backer boards, and wall tiles comprising:

a. A corner piece with slots (FIG. 1) and (FIG. 3) or holes (FIG. 4) and a full piece (FIG. 2) and (FIG. 6) with a breakaway connection;

b. Said corner piece configured, to be separated by application of force to create a corner section, and said, full peace with a breakaway connection configured to be adjusted up or down, in or out of a framing stud, to achieve plum alignment;

c. Said full piece further comprising slots. (FIG. 2) or holes (FIG. 5) with a predetermined fracture, location for facilitating, separation, and repositioning. These key features collectively contribute to the effectiveness, versatility, and user friendliness of the stud leveler;

d. Said stud leveling system constructed from materials, including plastics. (ABS, homopolymers, Acetal, polyoxymethylene, ABS-PC, Nylon, glass-field nylon, vinyl, HDPE, Polypropylene, or metals (aluminum) to ensure strength, durability, and compatibility with various construction materials;

e. A self-gripping mechanism that secures the stud leveling system to the framing stud, allowing for adjustment without manual support;

f. The stud leveling system configured for use with various types of wall boards, including plywood, Wooden paneling, sheet-rock wall boards, metal paneling, and more;

g. A flame retardant feature provided by incorporating a fireproof filament to reduce the risk of ignition and limit the spread of flames, enhancing fire, safety in construction environments.

The invention claimed is:

1. A stud leveling system configured for attachment to wall framing studs to establish a flat, plumb, and level substrate across a framed structure, the system comprising:

a first elongated member having a plurality of fastening holes and a predetermined fracture location, the first elongated member being configured for attachment to a stud at a top region and a bottom region thereof and for cooperative alignment with corresponding elongated members installed on adjacent studs;

a second elongated member having a plurality of adjustment slots and a predetermined fracture location, the second elongated member being configured for attachment between the first elongated members along the stud and being selectively adjustable inwardly or outwardly relative to the stud to establish a plumb reference plane extending across multiple studs;

a corner member formed by separation of one of the elongated members at the predetermined fracture location, the corner member being configured for installation at locations where a full-length elongated member cannot be positioned;

wherein the first elongated member and the second elongated member each include a compression-fit self-gripping feature adapted to elastically engage opposing side surfaces of the stud such that the elongated member retains itself in position on the stud without manual holding prior to fastening;

wherein the corner member is configured to cooperate structurally with the elongated members while omitting the compression-fit self-gripping feature; and wherein each of the elongated members is configured to be fastened to a side surface of the stud and to accommodate nail plates and fire blocks positioned along the stud.

2. The stud leveling system of claim 1, wherein the first elongated member is configured to be fastened to the stud at both an upper end and a lower end.

3. The stud leveling system of claim 1, wherein the second elongated member is adjustable relative to the stud prior to fastening to establish a continuous planar alignment across multiple studs.

4. The stud leveling system of claim 1, wherein the corner member is configured for installation at inside corners or outside corners of a framed structure.

5. The stud leveling system of claim 1, wherein the compression-fit self-gripping feature comprises elastic deformation of the elongated member against opposing side surfaces of the stud.

* * * * *